US006092686A

United States Patent [19]

Shaw et al.

[11] Patent Number: 6,092,686

[45] Date of Patent: Jul. 25, 2000

[54] COLLAPSIBLE LIQUID CONTAINMENT DEVICE

[75] Inventors: Mark D. Shaw, Ponte Vedra Bch.; J. Tad Heyman, Atlantic Beach; Laurence M. Bierce, MacClenny, all of Fla.

[73] Assignee: UltraTech International, Inc., Jacksonville, Fla.

[21] Appl. No.: 09/443,989

[22] Filed: Nov. 19, 1999

[51] Int. Cl.[7] ..... B65D 1/37

[52] U.S. Cl. ..... 220/573; 220/9.1

[58] Field of Search ..... 220/573, 571, 220/9.1, 9.2, 9.3

[56] References Cited

U.S. PATENT DOCUMENTS 92,364 7/1869 Rider .
5,090,588 2/1992 Van Romer et al. .
5,316,175 5/1994 Van Romer .
5,478,625 12/1995 Wright .
5,547,312 8/1996 Schmitz, Jr. .
5,762,233 6/1998 Van Romer .

*Primary Examiner*—Joseph M. Moy
*Attorney, Agent, or Firm*—Thomas C. Saitta

[57] ABSTRACT

A collapsible liquid containment device having a floor, side walls and peripheral skirt made of a flexible, foldable, liquid-impermeable material, where the side walls are supported by foldable brace members having an angled buttress member and an insertion member joined by a hinge, the buttress members being attached to the skirt. The insertion members are inserted into vertical pockets mounted on the exterior of the side walls, and the upper rim of the side walls is provided with a retention flap having a lower opening which receives the hinged joint between the buttress member and the insertion member. Preferably a rim support tab is affixed to the hinged joint to support the uppermost portion of the side wall. The brace members can be folded into a flat configuration when the insertion member is removed from the vertical pockets, allowing the entire device to be collapsed and folded.

11 Claims, 3 Drawing Sheets

COLLAPSIBLE LIQUID CONTAINMENT DEVICE

BACKGROUND OF THE INVENTION

This invention relates generally to the field of devices used to contain liquids, and especially such devices used as secondary containment to capture spills or run-offs of hazardous or non-environmentally-friendly liquids. More particularly, the invention relates to such devices which comprise a unified bottom and side walls to define a relatively large volume reservoir. Even more particularly, the invention relates to such devices which are collapsible and foldable into a relatively flat configuration for storage or transport, which can be rapidly and easily assembled or disassembled by the insertion or removal of brace members into or from flaps or pockets mounted onto the side walls, and where selected brace members can be removed from a portion of a side wall to allow a single side wall to collapse so that vehicles can be driven into the containment device.

There are numerous circumstances where it is desirable or required by law to contain certain hazardous liquids to prevent the liquids from entering the environment. For example, any spillage of liquids such as gasoline, oil, detergents, chemicals or the like during loading and unloading operations between liquid transport vehicles and storage tanks, during vehicle clean-up operations, or during vehicle fueling, must be captured and properly disposed of. Most locations where these events occur have no permanent recapture structures or systems, so it is necessary to provide a walled containment apparatus which is sufficient in size to allow a vehicle, such as a large tanker truck, to be positioned within its walls. Means to allow the vehicle to enter and exit the containment apparatus must also be provided. In general, apparatuses of this nature comprise pool-like structures, and typically are either fully rigid, have flexible walls of sheet material and gate means, have flexible walls and compressible wall support means, or have flexible walls and deformable or collapsible wall support means.

For example, U.S. Pat. No. 5,478,625 to Wright, shows a rigid containment device. Double-sided ramps at each end of the device enable a vehicle to be driven into and out of the device. An early collapsible container having flexible side walls and hinged grace members is shown in U.S. Pat. No. 92,364 to Rider. U.S. Pat. No. 5,547,312 to Schmitz, Jr., shows a pool-like apparatus having a floor and side walls made of a flexible sheet material. The walls are supported by a rigid frame having a peripheral upper member and a gate is provided at one end which can be lowered and raised to provide entry and exit means for the vehicle. U.S. Pat. No. 5,464,492 to Gregory et al. shows a containment device with walls supported by a foam member which is compressed by the vehicle wheel and which rebounds to create the wall when the vehicle wheel has passed. U.S. Pat. No. 5,090,588 to Van Romer et al. shows a device made of a flexible sheet material, where the wall is supported by a combination of vertical members adjacent the wall, a peripheral upper member, and internal brace members mounted to the floor of the device. The vertical support members and wall flex when a wheel passes over, and the brace members pull the wall back into the upright position after the wheel has passed. U.S. Pat. Nos. 5,316,175 and 5,762,233 to Van Romer show flexible-walled containment devices where non-vertical bracing members contain internal stiffener members.

It is an object of this invention to provide an improved liquid containment device for capturing liquid spills, especially such an apparatus which is foldable or collapsible into a generally flat configuration for storage or transport. It is a further object to provide such an device which is composed of flexible, liquid-impermeable, sheet material joined or folded to create a floor and side walls, where said side walls are supported by a number of spaced, removable, externally-mounted, brace members with no need for a peripheral upper support member. It is a further object to provide such a device where the brace members are relatively stiff and hinged, each having a vertical component, which is removably inserted into individual pockets, slots or flaps in the side walls, and an angled component, which is connected to an external floor skirt extending from the side walls. These and other objects are accomplished as set forth below.

SUMMARY OF THE INVENTION

The invention comprises in general a liquid containment device, configured as a pool or a floored berm, having a floor or bottom joined to a generally upstanding side wall or walls to define a capture area or reservoir to retain liquid or having the floor and side walls formed from a single, folded sheet member to define the reservoir area. The side walls of the apparatus are preferably relatively short in relation to the floor dimensions, and the walls and floor are formed of a flexible, liquid impermeable material having good durability and chemical resistance characteristics. The general configuration may be square, rectangular, circular, oval or any other desired shape. An external floor or ground level skirt member extends outward from the side walls.

The side walls are supported by a plurality of individual foldable brace members which are connected to the side walls and to the skirt member. The brace members are relatively stiff and comprise an insertion member joined in a hinged manner to a buttress member, which is connected in a hinged manner to the skirt member a short distance from the side wall. The insertion member of the brace has a free end which is inserted into a pocket, flap or similar retaining feature on the exterior of the side wall such that when so inserted the insertion member is disposed generally vertically or slightly inwardly inclined and the buttress member is disposed at an angle between horizontal and vertical. Preferably a short, relatively stiff, rim support tab is provided extending from the hinged connection between the buttress member and the insertion member, the support tab being of sufficient flexibility at the point of juncture such that it may be disposed generally vertically under pressure from the side wall. A continuous retention flap or individual flaps or pockets are mounted onto the external upper portion of the side walls to receive the support tabs and to prevent the side wall from sliding down or collapsing onto the insertion member. Horizontal floor braces may be positioned on the skirt at locations between the brace members. The insertion members are removable from the side wall pockets and the hinged joints allow the brace members to be disposed in a flat configuration parallel to the floor skirt, such that the containment device can be collapsed and folded into a generally flat storage or transport configuration as an integral unit.

DETAILED DESCRIPTION OF THE INVENTION

With reference to the drawings, the invention will now be described in detail with regard for the best mode and the preferred embodiment. In general, the invention is directed to a liquid containment or retention device in the nature of a pool or reservoir, composed primarily of a thin, flexible, liquid-impermeable sheet material provided with a plural number of braces to support the side walls of the device in a generally vertical manner, where the braces may be disconnected from the side walls such that the device can be collapsed into a relatively flat configuration and folded so as to occupy a relatively small volume for storage or transport.

Figure 1:
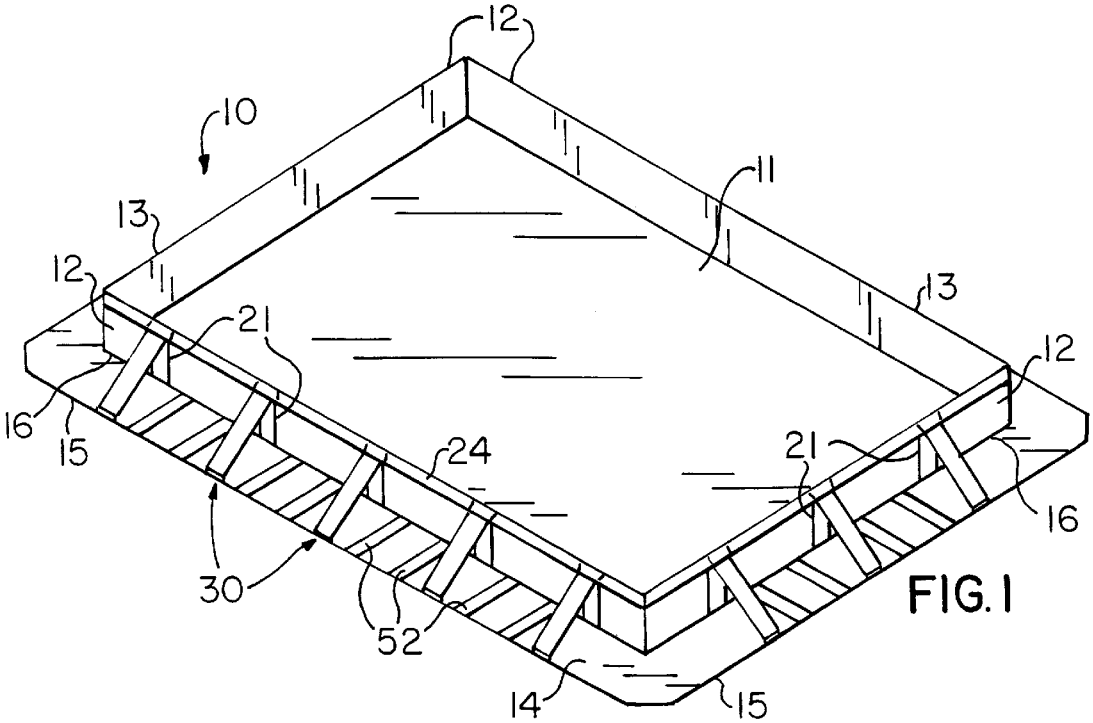
FIG. 1 is a perspective view of the invention.

As shown in FIG. 1, the invention is a liquid containment, pool or reservoir device 10 generally comprising a floor member 11 and side wall members 12 joined to define a liquid retaining area bounded by the upper rim 13 of the side walls 12. A peripheral ground or floor skirt member 14, preferably continuous, extends outwardly from the base 16 of the side walls 12 and generally co-planar with the floor 11. The floor 11, side walls 12 and skirt 14 are preferably composed of a relatively thin, flexible, liquid-impermeable, sheet material which is durable and resistant to chemical or environmental damage. The floor 11, side walls 12 and skirt 14 may be separate pieces joined by suitable adhesives, heat welding, mechanical fasteners or other suitable means to form the reservoir area. Preferably, the floor 11 and sides walls 12 are formed from a single piece of material so that there are no joints along the base 16 of the side walls 12 or at the corners. The overall configuration of the liquid containment device 10 may be rectangular as shown, but the device 10 can be configured in any other shape such as square, oval, circular, etc. The dimensions of the floor 11, side walls 12 and skirt 13 are not critical, but a vertical height of about twelve inches for the side walls 12 with a horizontal width from the wall base 16 of about ten inches for the skirt 13 is practical in many applications.

Figure 2:
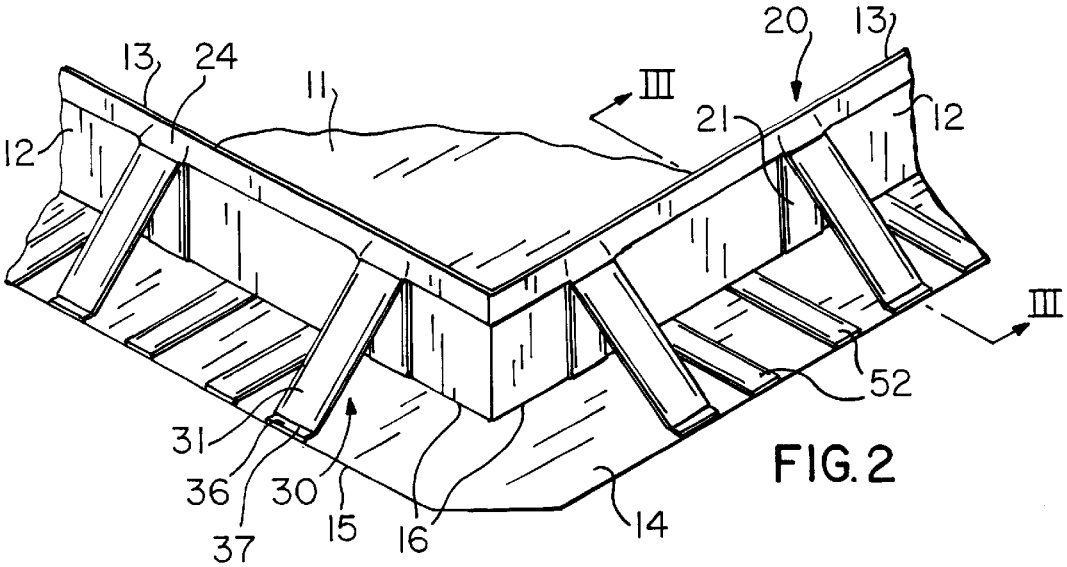
FIG. 2 is a partial perspective view showing a corner of the invention in the assembled state.
Figure 3:
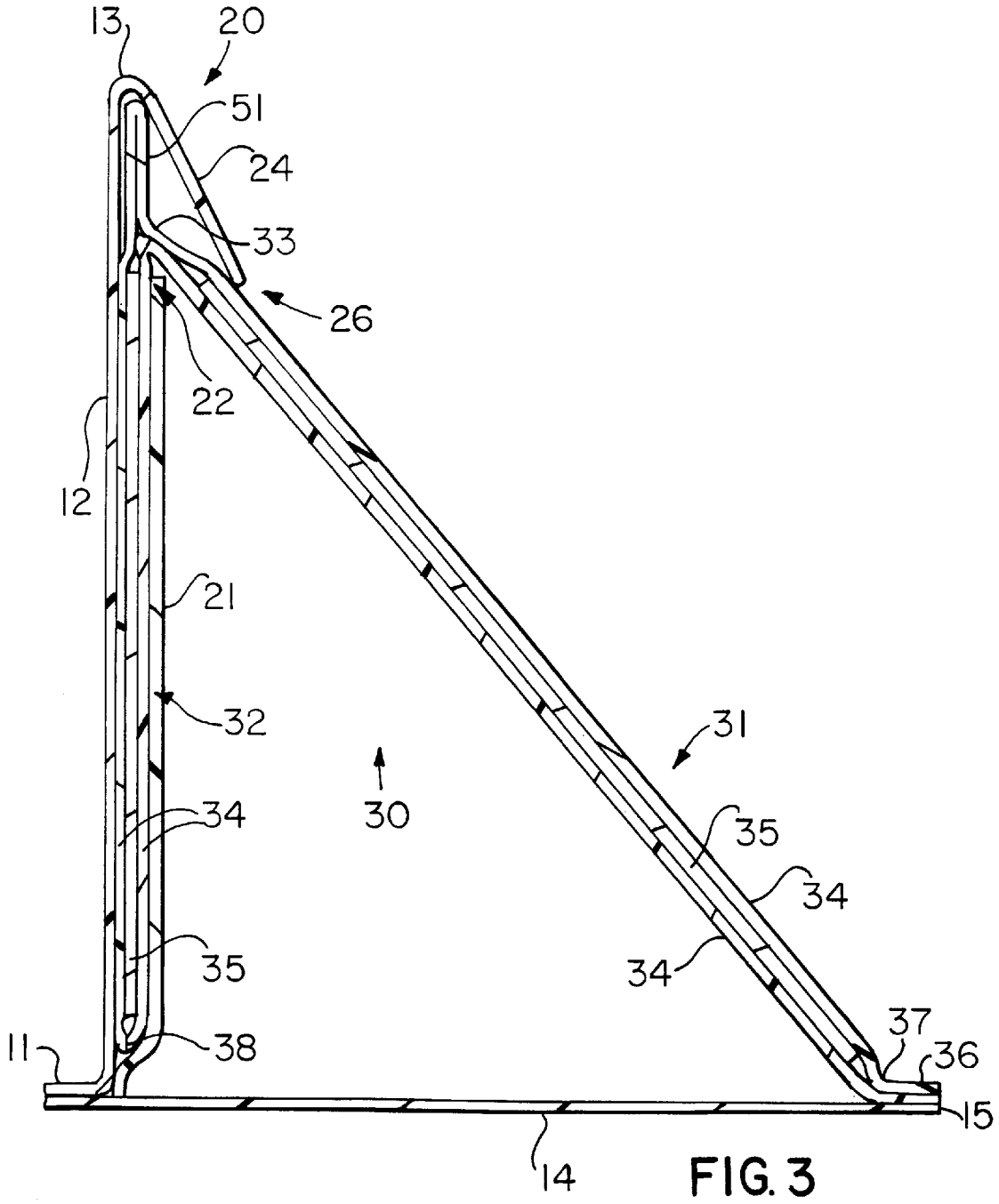
FIG. 3 is a cross-sectional view taken along line III—III of FIG. 2 showing the brace member in the assembled state.
Figure 4:
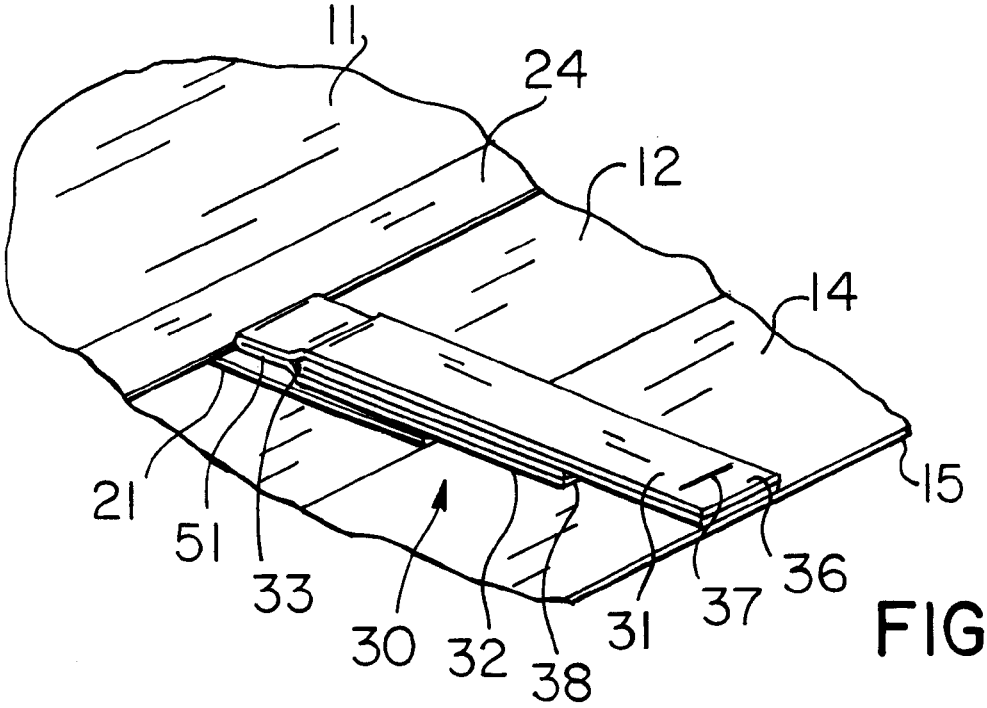
FIG. 4 is a partial perspective view of a brace member in the disassembled state.

As better seen in FIGS. 2 and 3, a plural number of foldable brace members 30 are disposed at preferably regular intervals along the exterior side of the side walls 12. For a side wall height of about twelve inches, spacing the brace members 30 at two foot intervals has been found to be sufficient to support the side walls 12 when the reservoir 10 is filled to capacity. The brace members 30 are hinged members composed of a relatively stiff buttress member 31 joined to a relatively stiff insertion member 32 at a flexible or hinged joint 33. The other end of the buttress member 31 is secured at or adjacent the outer edge 15 of skirt 14, preferably with a short attachment flange 36 which is joined to the buttress member 31 by a flexible flange joint 37. The other end of the insertion member 32 is a free end 38. In the embodiment shown in the drawings, the buttress member 31 and the insertion member 32 are each formed by enclosing a rigid stiffener member 35, preferably made of metal or rigid plastic, within a cover 34 of a relatively durable sheet material, the sheet material being of sufficient thickness and flexibility such that the cover material itself defines the flexible joint 33 and the flange joint 37, as well as the attachment flange 36. Alternatively, independent hinged components 33 and 37 can be connected to a separate buttress member 31, insertion member 32 and attachment flange 36 to form an individual brace member 30. Buttress member 31 is longer than insertion member 32, such that when insertion member 32 is abutting the side wall 12 in the supporting position, insertion member 32 will be disposed generally vertically or, preferably, inclined slightly inwardly toward the interior of the device 10. A slight inward incline is preferred for insertion member 32 in the support position as this provides stronger resistance against the externally directed forces of any large volume of liquid retained within the device 10. For a twelve inch side wall 12 and ten inch skirt 14, a length of about 15.5 inches for the buttress member 31 and about ten inches for the insertion member 32, with a width of about 3.5 inches for both, has been found suitable, although such dimensions may vary.

Brace retention means 20 are provided on side walls 12 to receive the brace members 30 in the wall-supporting position, as shown in FIGS. 1 through 3, such that the side walls 12 are disposed relatively vertically or slightly inwardly inclined when the brace members 30 are in place. Brace retention means 20 retain the brace members 30 in a non-permanent manner, such that the brace members 30 can be removed, released or disconnected from the brace retention means 20. Brace retention means 30 may comprise vertical pocket members 21 or slots 23, upper retention flaps 24 or pockets 25, or combinations of each.

Figure 5:
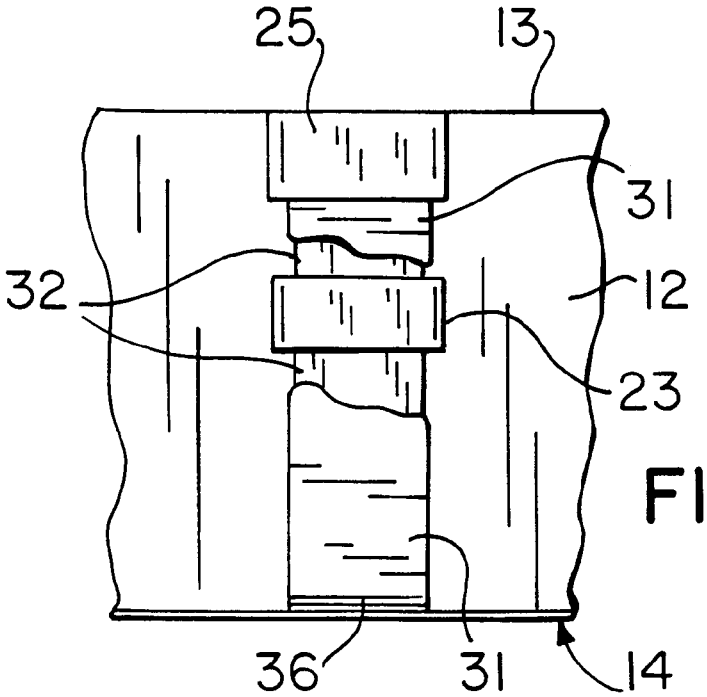
FIG. 5 is a front view of an alternative version of the brace retaining means on the side wall showing individual flap members and slots in the place of a continuous flap member and pockets.

In one embodiment, the free end 38 of the insertion member 32 of a brace member 30 is inserted into the upper opening 22 of a vertical pocket member 21, the pocket member 21 being sized to slightly exceed the width of the insertion member 32. Preferably a snug fit is achieved, such that friction between the pocket member 21, the insertion member 32 and the side wall 12 is sufficient to maintain the side wall 12 in the extended vertical direction. Alternatively, slots 23 may be used in place of pocket members 21, as shown in FIG. 5.

In an alternative embodiment, the brace retention means 20 comprises one or more retention flap members 24 with a lower opening 26 for insertion of the brace members 30. The retention flap member 24 may be a continuous member running the entire length of the upper rim 13 of the side walls 12, as shown in FIGS. 1 and 2, which may be joined by heat sealing, adhesives, stitching or the like to the side walls 12 at intermittent locations between the brace members 30 to limit relative movement of the flap member 24, or the flap members 24 may be segmented to form individual retention pockets 25, as shown in FIG. 5. With the brace member 30 disposed in the wall-supporting position, the flap member 24 or retention pocket 25 receives the hinged joint 33 portion of the brace member 30 through its lower opening 26, with the insertion member 32 extending generally vertically downward to the base 16 of the side wall 12 and the buttress member 31 angled downward to the edge 15 of the skirt 14. Thus flap member 24 or retention pocket 25 prevents the side wall 12 from collapsing.

Most preferably, brace retention means 30 comprises both the vertical pocket member 21 and the retention flap member 24, as this construction provides the most secure retention of the brace members 30 in the supporting position.

As shown in FIG. 3, the brace members 30 most preferably each further comprise a rim support tab member 51, which is positioned at the hinge joint 33 between the buttress member 31 and the insertion member 32. Rim support tab member 51 is a relatively stiff member which acts as an extension of the insertion member 32 in supporting the side walls 12. Tab member 51 is preferably joined to the hinge joint 33 in a somewhat flexible manner, such that tab member 51 extends generally vertically when the brace member 30 is in the wall-supporting position, the tab member 51 acting to support the upper rim 13 of the side wall 12. When the brace member 30 is in the non-supporting disposition, as shown in FIG. 5, the flexible joining allows the tab member 51 to lie in a generally co-planar relation with the buttress member 31. Alternatively, tab member 51 may be formed as agenerally co-planar extension of buttress member 31, such that the upper rim 13 will be supported at an inward angle. Tab member 51 may be formed by folding and securing a short segment of the cover material 34, either in a single or double layer, without recourse to insertion of any added stiffener means, or stiffener means may be incorporated within the tab member 51 in a manner similar to the buttress member 31 or insertion member 32.

Because the attachment flange 36 of each brace member 30 is connected to the skirt 14 a short distance from the side walls 12, no horizontal braces or stiffeners are required. The angled relation between the insertion member 32 and buttress member 31, with the insertion member 32 restrained by the vertical pocket 21, and especially with the upper rim 13 of the side walls 12 mounted onto the hinge joint 33 between the insertion and buttress members 32 and 31, is sufficient to support the side walls 12 against the weight of the retained liquid. If desired, horizontal floor brace members 52 may be provided interspaced between the brace members 30, the floor brace members 52 preferably comprising rigid members of metal or plastic affixed to the skirt 14.

To collapse the device 10 for storage or transport, the insertion member 32 is removed from the vertical pocket member 21 and folded against the buttress member 31, as shown in FIG. 5. The side wall 12 may then be folded inwardly onto the floor 11 to crate a relatively flat profile. The brace members 30 remain attached to the skirt 14 so no components must be separated and accounted for. The entire device 10 can now be folded or rolled to provide for a small volume configuration easy to handle, transport and store until needed.

It is contemplated that substitutions or equivalents for certain components set forth above may be obvious to those skilled in the art, and the true scope and definition of the invention therefore is to be as set forth in the following claims.

We claim:

1. A collapsible liquid containment device comprising a floor, side walls joined to said floor to define a reservoir area, said side walls having a base and an upper rim, a peripheral ground skirt extending outwardly from said side walls, said floor and side walls composed of a foldable, flexible, liquid-impermeable material, foldable brace members for supporting said side walls in a generally vertically disposed manner such that liquid may be retained within said device, and brace retention means mounted on said side walls for retaining said brace members against said side walls in a wall-supporting position, said brace members each comprising a rigid buttress member joined to a rigid insertion member by a flexible hinge joint, said buttress member connected to said skirt member, said insertion member having a free end insertable into said brace retention means such that said insertion member abuts and supports said side wall in a generally vertical manner with said buttress member disposed at an angle against said side wall, where said insertion member can be removed from said brace retention means and folded against said buttress member such that said brace members are generally flat and said side walls can be folded against said floor.

2. The device of claim 1, where said brace retention means further retains said flexible hinge joint of said brace member.

3. The device of claim 1, where said brace retention means comprises a plural number of pocket members mounted on said side walls, said pocket members each having an upper opening to receive said insertion member.

4. The device of claim 2, where said brace retention means comprises a retention flap member mounted adjacent said upper rim of said side walls, said retention flap member having a lower opening to receive said flexible hinged joint of said brace member.

5. The device of claim 4, where said brace retention means comprises a plural number of pocket members mounted on said side walls, said pocket members each having an upper opening to receive said insertion member.

6. The device of claim 4, where said brace members each further comprise a rim support tab member mounted at said flexible hinged joint, said tab member disposed within said retention flap member and supporting said upper rim of said side walls when said brace members are disposed in the wall-supporting position.

7. The device of claim 1, said buttress members and said insertion members each composed of a stiffener member retained within a cover member, where said cover member is formed of a flexible material and composes said flexible hinged joint.

8. The device of claim 1, further comprising floor brace members connected to said skirt member at locations between said brace members.

9. The device of claim 1, where said brace retention means comprises a plural number of slots mounted on said side walls, said slots each having an upper opening to receive said insertion member.

10. The device of claim 2, where said brace retention means comprises a plural number of retention pocket member mounted adjacent said upper rim of said side walls, said retention pocket members having a lower opening to receive said flexible hinged joint of said brace member.

11. The device of claim 1, said brace members each further comprising an attachment flange flexibly connected to said buttress member, said attachment flange attached to said skirt member.

* * * * *